US006684650B2

(12) United States Patent
Weyna et al.

(10) Patent No.: US 6,684,650 B2
(45) Date of Patent: Feb. 3, 2004

(54) SYSTEM AND METHOD FOR RAPID DEFROST OR HEATING IN A MOBILE REFRIGERATION UNIT

(75) Inventors: Paul Valentine Weyna, Manlius, NY (US); Richard Alan Simone, Baldwinsville, NY (US); Russell George Lewis, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/057,217

(22) Filed: Jan. 24, 2002

(65) Prior Publication Data

US 2003/0136137 A1 Jul. 24, 2003

(51) Int. Cl.[7] ..... F25D 21/06
(52) U.S. Cl. ..... 62/151; 62/278
(58) Field of Search ..... 62/129, 227, 126, 62/158, 228.3, 125, 127, 278, 228.1, 228.2, 151

(56) References Cited

U.S. PATENT DOCUMENTS 5,157,933 A 10/1992 Brendel
5,509,274 A * 4/1996 Lackstrom ..... 62/238.4
5,522,231 A * 6/1996 Kenyon et al. ..... 62/129
5,553,997 A * 9/1996 Goshaw et al. ..... 415/17
5,630,325 A * 5/1997 Bahel et al. ..... 62/222
5,791,155 A * 8/1998 Tulpule ..... 62/211
5,806,327 A * 9/1998 Lord et al. ..... 62/115
6,233,952 B1 5/2001 Porter et al.
6,263,686 B1 7/2001 Burkhart
6,272,870 B1 * 8/2001 Schaeffer ..... 62/205
6,298,673 B1 * 10/2001 Fung et al. ..... 62/82

* cited by examiner

*Primary Examiner*—Melvin Jones
(74) *Attorney, Agent, or Firm*—Wall Marjama & Bilinski LLP

(57) ABSTRACT

A method and system for executing a hot gas heating cycle in a mobile refrigeration unit includes diverting a flow of hot gas by bypassing a condenser into a receiver and restricting the flow, thereby raising a discharge pressure and temperature of the unit. The discharge pressure of the unit is monitored, and the restriction is regulated when the discharge pressure reaches a predetermined pressure. A combination of small and large orifice hot gas valves is used, or optionally a hot gas stepper valve. A solenoid valve or an evaporator expansion valve is optionally used to meter refrigerant into the heat loop.

20 Claims, 3 Drawing Sheets

SYSTEM AND METHOD FOR RAPID DEFROST OR HEATING IN A MOBILE REFRIGERATION UNIT

FIELD OF THE INVENTION

This invention relates generally to the field of mobile refrigeration systems, and more particularly to a mobile refrigeration system with a hot gas heating cycle.

BACKGROUND OF THE INVENTION

The known heat and defrost algorithms which control mobile refrigeration units use solenoid operated valves to control the hot gas flow. Slow heating to the setpoint as well as long defrost times are common using the prior art algorithms. At low ambient temperatures, trailer refrigeration units with hot gas heating heat very slowly, which leads to inefficiencies.

SUMMARY OF THE INVENTION

Briefly stated, a method and system for executing a hot gas heating cycle in a mobile refrigeration unit includes diverting a flow of hot gas by bypassing a condenser into a receiver and restricting the flow, thereby raising a discharge pressure and temperature of the unit. The discharge pressure of the unit is monitored, and the restriction is regulated when the discharge pressure reaches a predetermined pressure. A combination of small and large orifice hot gas valves is used, or optionally a hot gas stepper valve. A solenoid valve or an evaporator expansion valve is optionally used to meter refrigerant into the heat loop.

According to an embodiment of the invention, a method for executing a hot gas heating cycle in a mobile refrigeration unit includes the steps of (a) opening a hot gas stepper valve followed by closing a condenser valve between a condenser and a receiver; (b) monitoring a discharge pressure in the unit; (c) comparing the discharge pressure to a first predetermined pressure; (d) closing, after step (c), the hot gas stepper valve if the hot gas heating cycle is unfinished and the discharge pressure is less than the fist predetermined pressure; (e) opening, after step (c), the hot gas stepper valve if the discharge pressure is greater than or equal to the first predetermined pressure; and (f) opening, after step (c), the condenser valve followed by closing the hot gas stepper valve if the hot gas heating cycle is finished.

According to an embodiment of the invention, a method for executing a hot gas heating cycle in a mobile refrigeration unit includes the steps of opening a small orifice hot gas valve bypassing a condenser; monitoring a discharge pressure in the unit; comparing the discharge pressure to a first predetermined pressure; opening a large orifice hot gas valve when the discharge pressure is greater than the first predetermined pressure by a first specified amount; and closing one of the small orifice hot gas valve and the large orifice hot gas valve when the discharge pressure is less than the first predetermined pressure by a second specified amount.

According to an embodiment of the invention, a method for executing a hot gas heating cycle in a mobile refrigeration unit includes the steps of restricting a flow of hot gas bypassing a condenser into a receiver, thereby raising a discharge pressure of the unit; monitoring the discharge pressure of the unit; and controlling restriction of the flow of hot gas when the discharge pressure reaches a predetermined pressure.

According to an embodiment of the invention, a system for executing a hot gas heating cycle in a mobile refrigeration unit includes means for opening a hot gas stepper valve followed by closing a condenser valve between a condenser and a receiver; means for monitoring a discharge pressure in the unit; means for comparing the discharge pressure to a first predetermined pressure; means for closing the hot gas stepper valve if the hot gas heating cycle is unfinished and the discharge pressure is less than the fist predetermined pressure; means for opening the hot gas stepper valve if the discharge pressure is greater than or equal to the first predetermined pressure; and means for opening the condenser valve followed by closing the hot gas stepper valve if the hot gas heating cycle is finished.

According to an embodiment of the invention, a system for executing a hot gas heating cycle in a mobile refrigeration unit includes means for opening a small orifice hot gas valve bypassing a condenser; means for monitoring a discharge pressure in the unit; means for comparing the discharge pressure to a first predetermined pressure; means for opening a large orifice hot gas valve when the discharge pressure is greater than the first predetermined pressure by a first specified amount; and means for closing one of the small orifice hot gas valve and the large orifice hot gas valve when the discharge pressure is less than the first predetermined pressure by a second specified amount.

According to an embodiment of the invention, a system for executing a hot gas heating cycle in a mobile refrigeration unit includes means for restricting a flow of hot gas bypassing a condenser into a receiver, thereby raising a discharge pressure of the unit; means for monitoring a discharge pressure of the unit; and means for ceasing restriction of the flow of hot gas when the discharge pressure reaches a predetermined pressure.

DETAILED DESCRIPTION OF THE PREFERRED EMBODIMENT

Figure 1:
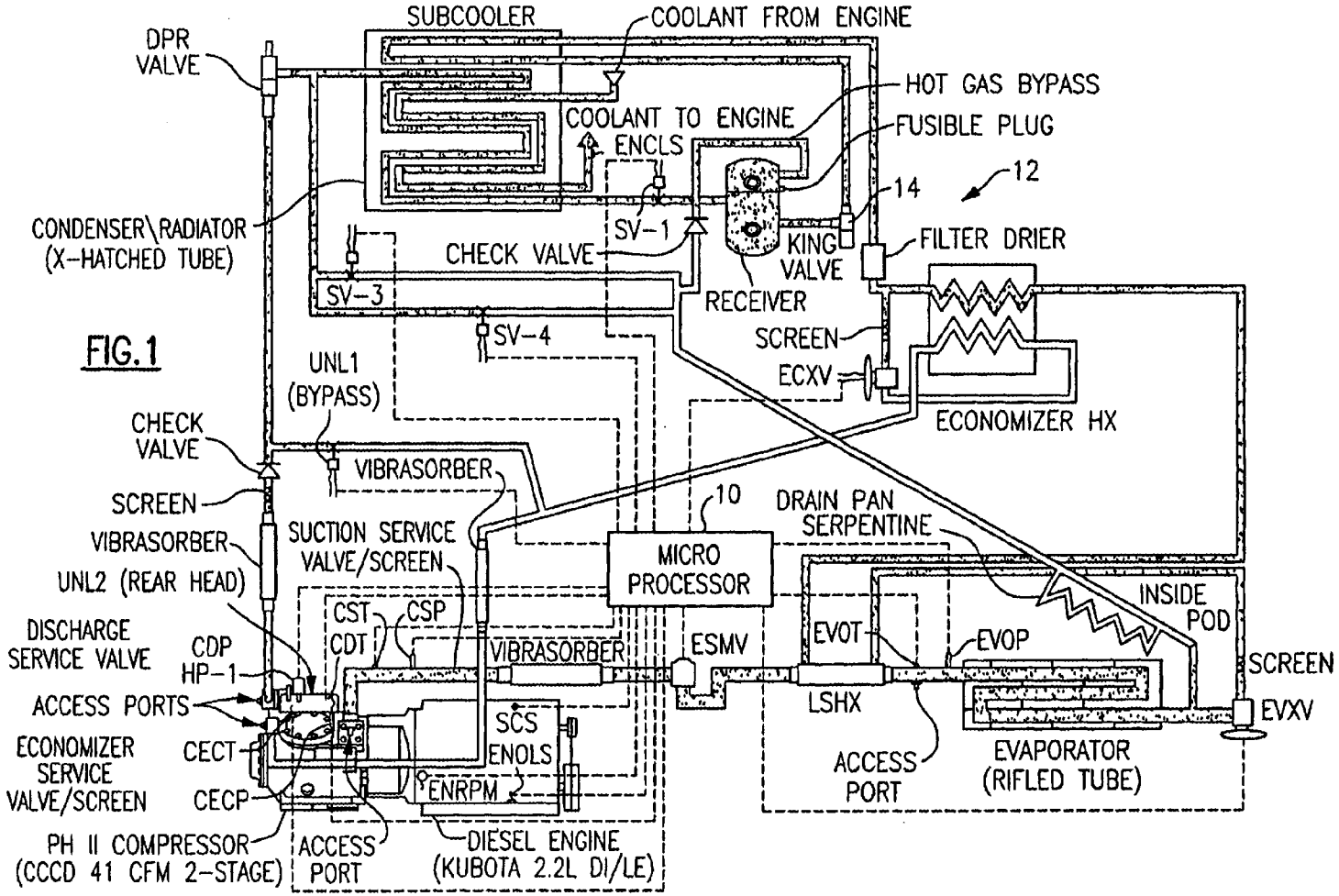
FIG. 1 shows a system schematic of an embodiment of a mobile refrigeration unit.

Referring to FIG. 1, a system schematic of a mobile refrigeration unit 12 is shown. Mobile units use the same conventional refrigeration cycle as other units, but with modifications that provide greater cooling capacity with a smaller physical structure than is generally obtained in stationary units. The following abbreviations are used in the figures.

| | |
|---|---|
| DPR | discharge pressure regulator |
| SV | solenoid valve |
| ECXV | economizer expansion valve |
| HX | heat exchanger |
| UNL | unloader |
| CDP | compressor discharge pressure |
| HP | high pressure switch |
| CDT | compressor discharge temperature |
| CST | compressor suction temperature |
| CSP | compressor suction pressure |
| CECT | compressor economizer temperature |
| CECP | compressor economizer pressure |
| ESMV | electronic suction modulation valve |
| LSHX | liquid to suction heat exchanger |

-continued

| | |
|---|---|
| EVOT | evaporator outlet temperature |
| EVOP | evaporator outlet pressure |
| EVXV | evaporator expansion valve |
| ENRPM | engine RPM |
| ENOLS | engine oil level switch |
| HGSV | hot gas stepper valve |

The various sensors and valves in unit 12 are connected to a microprocessor 10. The improvements sought in the present invention are decreased defrost time, decreased heating time to setpoint, and increased system reliability. Unit 12 heats via a hot gas de-superheating cycle.

An embodiment of the invention is a system and method which uses a discharge pressure transducer CDP to control hot gas valves SV-3 and SV-4 in order to raise the discharge pressure, and thus the discharge temperature quickly. Restricting the flow quickly raises discharge pressure and thus quickly raises the discharge temperature, thereby increasing the heat transfer.

As an example, single small orifice hot gas valve SV-4 is opened until the discharge pressure rises to an acceptable predetermined level such as 300 psig. If the discharge pressure rises above the desired pressure by some predetermined amount, then a larger hot gas valve SV-3 is opened to reduce the restriction, thus lowering the discharge pressure. If the discharge pressure falls to some predetermined pressure, such as 250 psig, close either valve SV-4, valve SV-3, or both, to increase discharge pressure.

The compressor shaft seal is preferably protected by preventing a vacuum in the crankcase. This is accomplished by increasing mass flow by keeping both valves SV-4 and SV-3 open until the suction pressure rises to an acceptable positive pressure level, such as 10 psig. The discharge pressure is preferably raised to an acceptable value by using electronic expansion valve EVXV, discharge pressure transducer CDP, and microprocessor 10 to meter refrigerant into the heat loop.

Figure 2:
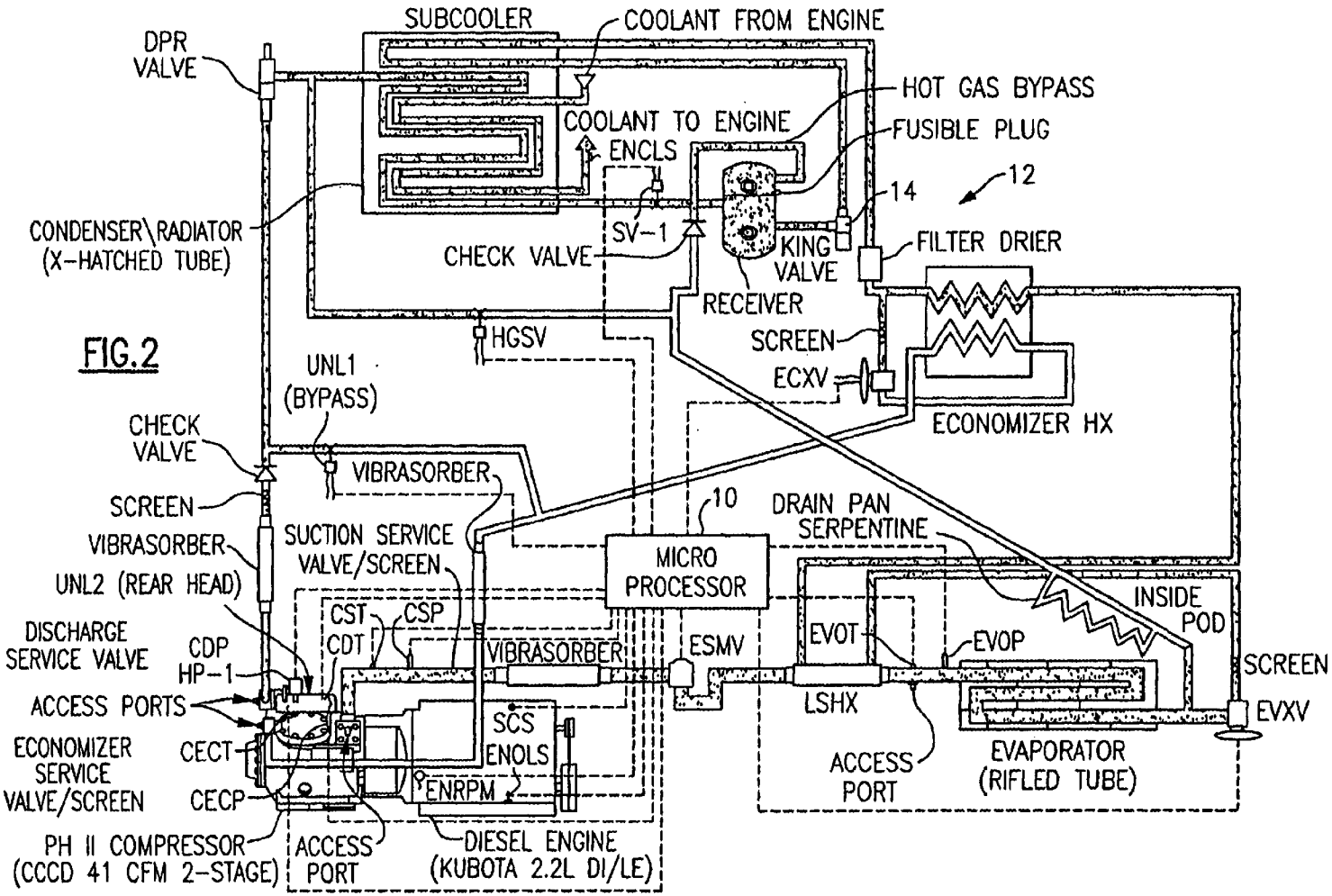
FIG. 2 shows a system schematic of an embodiment of a mobile refrigeration unit.

Referring to FIG. 2, another embodiment of the present invention is shown. Discharge pressure transducer CDP reads the discharge pressure and provides this information to microprocessor 10. This embodiment differs from the previous embodiment in that an electronic hot gas stepper valve HGSV is used in the system instead of hot gas valves SV-3 and SV-4.

Figure 3:
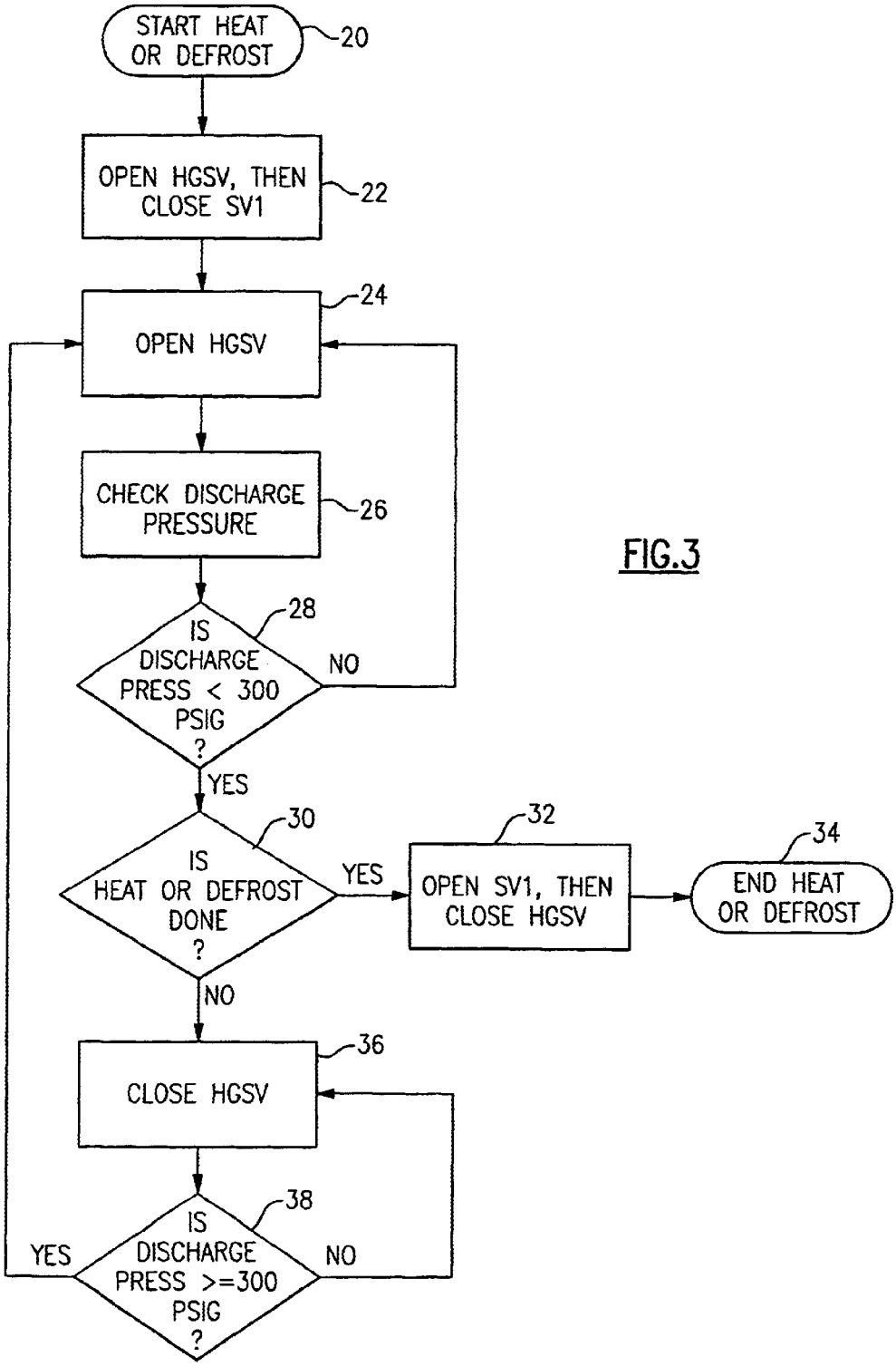
FIG. 3 shows a flow chart used in conjunction with FIG. 2 in explaining an embodiment of the invention.

Referring to FIG. 3, the hot gas heating or defrost process is begun as follows at step 20. At step 22, valve HGSV is opened, after which valve SV-1 is closed. With valve HGSV open (step 24), the discharge pressure is checked by transducer CDP in step 26 to see if it has reached 300 psig (step 28). Once the discharge pressure reaches a predetermined pressure such as 300 psig, valve HGSV remains open and the discharge pressure is continuously checked until the discharge pressure drops below 300 psig. If the discharge pressure is below 300 psig, the system checks to see if the heat or defrost cycle is finished in step 30. If yes, valve SV-1 is opened followed by closing valve HGSV in step 32. The heat or defrost cycle is then ended in step 34.

If the heat or defrost cycle is continuing, and the discharge pressure is below 300 psig, valve HGSV is closed in step 36. The valve remains closed (step 38 looping back to step 36) until the discharge pressure reaches 300 psig, at which point valve HGSV is opened in step 24.

Restricting the flow using valve HGSV quickly raises the discharge pressure and thus quickly raises the discharge gas temperature, thereby increasing the heat transfer. A control algorithm in microprocessor 10 preferably opens and closes valve HGSV to maintain the suction and discharge pressures at a predetermined pressure.

In addition to the process just described, the hot gas heating or defrost process can be improved by using electronic evaporator expansion valve EVXV. Valve EVXV can be opened to meter refrigerant into the heating circuit, to raise discharge pressure further if needed, and closed when discharge pressure reaches an acceptable pressure.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A method for executing a hot gas heating cycle in a mobile refrigeration unit, comprising the steps of:

(a) opening a hot gas stepper valve followed by closing a condenser valve between a condenser and a receiver;

(b) monitoring a discharge pressure in said unit;

(c) comparing said discharge pressure to a first predetermined pressure;

(d) closing, after step (c), said hot gas stepper valve if said hot gas heating cycle is unfinished and said discharge pressure is less than said fist predetermined pressure;

(e) opening, after step (c), said hot gas stepper valve if said discharge pressure is greater than or equal to said first predetermined pressure; and (f) opening, after step (c), said condenser valve followed by closing said hot gas stepper valve if said hot gas heating cycle is finished.

2. A method according to claim 1, further comprising the step of opening an evaporator expansion valve when said discharge pressure is less than a second predetermined pressure and closing said evaporator expansion valve when said discharge pressure is greater than or equal to said second predetermined pressure.

3. A method according to claim 2, wherein said first and second predetermined pressures are the same pressure.

4. A method for executing a hot gas heating cycle in a mobile refrigeration unit, comprising the steps of:

opening a small orifice hot gas valve bypassing a condenser;

monitoring a discharge pressure in said unit;

comparing said discharge pressure to a first predetermined pressure;

opening a large orifice hot gas valve when said discharge pressure is greater than said first predetermined pressure by a first specified amount; and closing one of said small orifice hot gas valve and said large orifice hot gas valve when said discharge pressure is less than said first predetermined pressure by a second specified amount.

5. A method according to claim 4, further comprising the step of opening an evaporator expansion valve when said discharge pressure is less than a second predetermined pressure and closing said evaporator expansion valve when said discharge pressure is greater than or equal to said second predetermined pressure.

6. A method according to claim 5, wherein said first and second predetermined pressures are the same pressure.

7. A method according to claim 5, further comprising the steps of:

monitoring a suction pressure of said unit; and keeping both of said valves open until said suction pressure reaches a specified pressure.

8. A method according to claim 4, further comprising the steps of:

monitoring a suction pressure of said unit; and keeping both of said valves open until said suction pressure reaches a specified pressure.

9. A method for executing a hot gas heating cycle in a mobile refrigeration unit, comprising the steps of:

restricting a flow of hot gas bypassing a condenser into a receiver, thereby raising a discharge temperature of said unit;

monitoring a discharge pressure of said unit; and controlling restriction of said flow of hot gas when said discharge temperature reaches a predetermined temperature.

10. A method according to claim 9, further comprising the step of opening an evaporator expansion valve when said discharge temperature is less than said predetermined temperature and closing said evaporator expansion valve when said discharge temperature is greater than or equal to said predetermined temperature.

11. A system for executing a hot gas heating cycle in a mobile refrigeration unit, comprising:

means for opening a hot gas stepper valve followed by closing a condenser valve between a condenser and a receiver;

means for monitoring a discharge pressure in said unit;

means for comparing said discharge pressure to a first predetermined pressure;

means for closing said hot gas stepper valve if said hot gas heating cycle is unfinished and said discharge pressure is less than said fist predetermined pressure;

means for opening said hot gas stepper valve if said discharge pressure is greater than or equal to said first predetermined pressure; and means for opening said condenser valve followed by closing said hot gas stepper valve if said hot gas heating cycle is finished.

12. A system according to claim 11, further comprising means for opening an evaporator expansion valve when said discharge pressure is less than a second predetermined pressure and closing said evaporator expansion valve when said discharge pressure is greater than or equal to said second predetermined pressure.

13. A system according to claim 12, wherein said first and second predetermined pressures are the same pressure.

14. A system for executing a hot gas heating cycle in a mobile refrigeration unit, comprising:

means for opening a small orifice hot gas valve bypassing a condenser;

means for monitoring a discharge pressure in said unit;

means for comparing said discharge pressure to a first predetermined pressure;

means for opening a large orifice hot gas valve when said discharge pressure is greater than said first predetermined pressure by a first specified amount; and means for closing one of said small orifice hot gas valve and said large orifice hot gas valve when said discharge pressure is less than said first predetermined pressure by a second specified amount.

15. A system according to claim 14, further comprising means for opening an evaporator expansion valve when said discharge pressure is less than a second predetermined pressure and closing said evaporator expansion valve when said discharge pressure is greater than or equal to said second predetermined pressure.

16. A system according to claim 15, wherein said first and second predetermined pressures are the same pressure.

17. A system according to claim 15, further comprising:

means for monitoring a suction pressure of said unit; and means for keeping both of said valves open until said suction pressure reaches a specified pressure.

18. A system according to claim 14, further comprising:

means for monitoring a suction pressure of said unit; and means for keeping both of said valves open until said suction pressure reaches a specified pressure.

19. A system for executing a hot gas heating cycle in a mobile refrigeration unit, comprising:

means for restricting a flow of hot gas bypassing a condenser into a receiver, thereby raising a discharge temperature of said unit;

means for monitoring said discharge temperature of said unit; and means for ceasing restriction of said flow of hot gas when said discharge temperature a predetermined temperature.

20. A method according to claim 19, further comprising means for opening an evaporator expansion valve when said discharge temperature is less than said predetermined temperature and closing said evaporator expansion valve when said discharge temperature is greater than or equal to said predetermined temperature.

* * * * *

UNITED STATES PATENT AND TRADEMARK OFFICE

CERTIFICATE OF CORRECTION

PATENT NO. : 6,684,650 B2
DATED : February 3, 2004
INVENTOR(S) : Weyna et al.

It is certified that error appears in the above-identified patent and that said Letters Patent is hereby corrected as shown below:

Column 4,
Line 28, before the word "predetermined" please delete "fist" and replace with the word -- first --.

Signed and Sealed this

Thirtieth Day of March, 2004

JON W. DUDAS
*Acting Director of the United States Patent and Trademark Office*